United States Patent [19]

Notelteirs

[11] Patent Number: 4,894,519

[45] Date of Patent: Jan. 16, 1990

[54] ELECTRIC COOKER UNIT AND ELECTRIC COOKING APPARATUS PROVIDED WITH IT

[75] Inventor: Victor R. Notelteirs, Turnhout, Belgium

[73] Assignee: U.S. Philips Corporation, New York, N.Y.

[21] Appl. No.: 344,541

[22] Filed: Apr. 25, 1989

Related U.S. Application Data

[63] Continuation of Ser. No. 168,195, Mar. 15, 1988, abandoned.

[30] Foreign Application Priority Data

Mar. 30, 1987 [NL] Netherlands ..... 8700734

[51] Int. Cl.[4] ..... H05B 3/74

[52] U.S. Cl. ..... 219/464; 219/465

[58] Field of Search ..... 219/464, 465, 466, 467, 219/354, 458, 460

[56] References Cited

U.S. PATENT DOCUMENTS

| | | | |
|---|---|---|---|
| 3,355,574 | 11/1967 | Bassett | 219/464 |
| 3,557,991 | 1/1971 | Wittek . | |
| 4,551,616 | 11/1985 | Buttery | 219/460 |
| 4,551,617 | 11/1985 | Crossley | 219/466 |
| 4,556,786 | 12/1985 | Frost | 219/464 |
| 4,598,194 | 7/1986 | Halberstadt | 219/464 |
| 4,700,051 | 10/1987 | Goessler | 219/466 |

FOREIGN PATENT DOCUMENTS 2089563 6/1982 United Kingdom .

*Primary Examiner*—Teresa J. Walberg
*Attorney, Agent, or Firm*—Brian J. Wieghaus

[57] ABSTRACT

The electric cooker unit having a housing with a base wall and upright side walls provided with openings. A thermal isolator may be arranged along the walls. The unit further has an electric IR lamp having a lamp vessel provided with pinch seals. The openings are slots merging into the edge of the side walls. A pinched seal has a profile on the major faces, which limit a displacement of the lamp in the housing.

14 Claims, 1 Drawing Sheet

ELECTRIC COOKER UNIT AND ELECTRIC COOKING APPARATUS PROVIDED WITH IT

This is a continuation of application Ser. No. 168,195 filed Mar. 15, 1988, now abandoned.

BACKGROUND OF THE INVENTION

The invention relates to an electric cooker unit comprising an electric IR lamp provided with a tubular glass lamp vessel sealed in a vacuum-tight manner and having an axis and flat pinched seals each having two major surfaces. A filament is axially arranged in the lamp vessel and current supply conductors extend from the filament through a respective pinched seal to the exterior. A housing for receiving a respective pinched seal of the electric IR lamp is provided with a base wall, and side walls standing on the base wall. An edge is remote from the base wall and openings.

The invention further relates to an electric cooking apparatus provided with such a cooker unit.

Such a cooker unit and such a cooking apparatus are generally known.

A disadvantage of the known cooker unit is that the lamp can be displaced along the lamp axis during transport, as a result of which a pinch seal is located for the major part within the housing. The temperature of said pinched seal can then become very high during operation, which may result in the pinch seals being destroyed and the lamp becoming defective.

Such a displacement of the lamp is possible due to the fact that detachable electrical and also mechanical connections of the lamp are arranged at a great distance from the lamp vessel in order to avoid corrosion. The lamp mostly has a fixed connection between its current supply connectors and a respective cable. The cables ensure that the lamp remains electrically connected to the current source, but they cannot ensure that the lamp remains mechanically fixed.

Although it is possible to provide the cooker unit with means for holding the lamp mechanically, these means cause the cost price of the cooker unit to increase.

SUMMARY OF THE INVENTION

The invention has for its object to provide a cooker unit of the kind described in the opening paragraph, which has a very simple construction and in which displacement of the lamp is limited.

According to the invention, this object is achieved in an electric cooker unit of the kind described in the opening paragraph in that the openings in the side walls are slots which merge into the said edge and at least one pinch seal of the lamp has a profile cooperating with the respective side wall of the housing to limit displacement of the lamp along its axis in the housing.

The electric cooker unit according to the invention not only is effective and of simple construction, but can also be manufactured in a simple manner. Thus, the profile of the pinched seal is automatically obtained during the formation of said seal by using pinch blocks adapted thereto. By an accurate dimensioning, it is further possible to avoid an axial displacement of the lamp.

The profile can be present on a minor face of the pinched seal, but a profile on a major face can be very readily formed.

In a favorable embodiment, a major face of each of the two pinched seals has a profile. In a variation thereof, the two major faces of each of the two pinched seals have a profile. Thus, the admissible spread in dimensions, for example, thickness, of the tubular glass of the lamp, and width of the slot, is increased without the fixing of the lamp being influenced.

The profile may comprise a groove extending over a pinched seal transverse to the axis of the lamp vessel. Alternatively, the profile may comprise a projection.

It may be desirable that the pinched seals are each held at their free end in a ceramic lamp cap in order to shield the current supply conductor emanating from the pinched seal. This has for its object to prevent touching. For example, a cable connected to the current supply conductor and isolated by a sheath may emanate from said lamp cap. In the case of rupture of the pinched seal during transport, the connection between the cable and the current supply conductor is prevented from being located against the housing and from causing a shortcircuit when connected to a current source.

In a favorable embodiment, said lamp cap has respective recesses, in which a respective said projection is accomodated. The lamp cap is generally fixed on the pinch seal by means of cement. In this embodiment, the function of the projection is supported by the lamp cap. The housing of a cooker unit may have a thermal isolation along the walls, for example of soft ceramic material.

BRIEF DESCRIPTION OF THE DRAWINGS

Embodiments of the electric cooker unit and the electric cooker apparatus are shown in the drawing. In the drawing.

DESCRIPTION OF THE PREFERRED EMBODIMENTS

Figure 1:
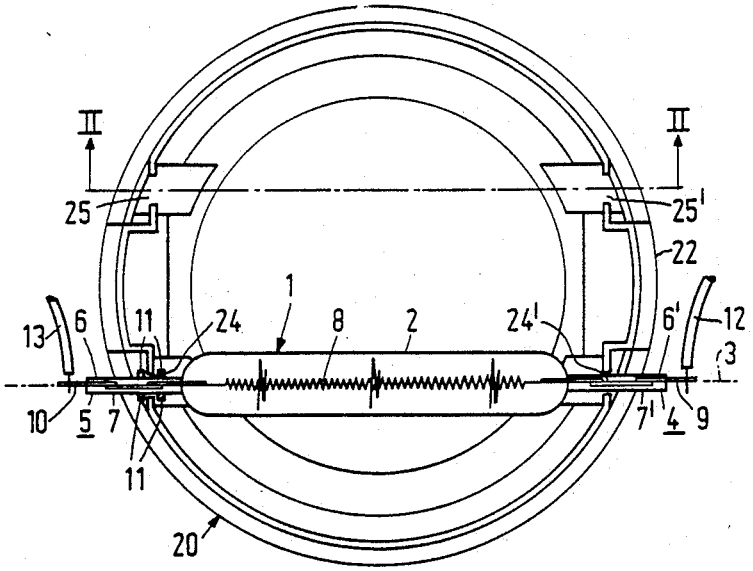
FIG. 1 shows in plan view a cooker unit.

In FIG. 1, the electric cooker unit has an electric IR lamp 1 provided with a tubular glass lamp vessel 2 sealed in a vacuum-tight manner and having an axis 3 and flat pinched seals 4,5 each having two major faces 6',7' and 6,7, respectively. The lamp vessel 2 is filled with a halogen-containing gas. A filament 8 is axially arranged in the lamp vessel 2. Current supply conductors 9,10 extend from the filament 8 via a respective pinched seal 4,5 to the exterior. In the embodiment shown, they are connected there fixedly to a cable 12 and 13, respectively. The cooker unit further has a housing 20 provided with a base wall 21 (FIG. 2) and side walls 22 standing on said base wall and having an edge 23 remote from said base wall 21 and openings 24,24' (25,25') for receiving a respective pinched seal 5,4 of the electric IR lamp 1. A thermal isolator 26 of, for example, soft ceramic material is arranged in the housing 20 along the walls 21,22.

The openings 24,24', 25,25' are slots merging into the edge 23 of the side walls 22 remote from the base wall 21. At least one pinched seal 5 of the IR lamp has a profile 11 cooperating with the relevant side wall 22 of the housing 20 to limit axial displacement of the lamp 1 in the housing 20.

In the embodiment shown, a profile 11 is present on each of the two major faces 6,7. The profile 11 of a major face consists of two projections located on either side of the side wall 22.

Figure 3:
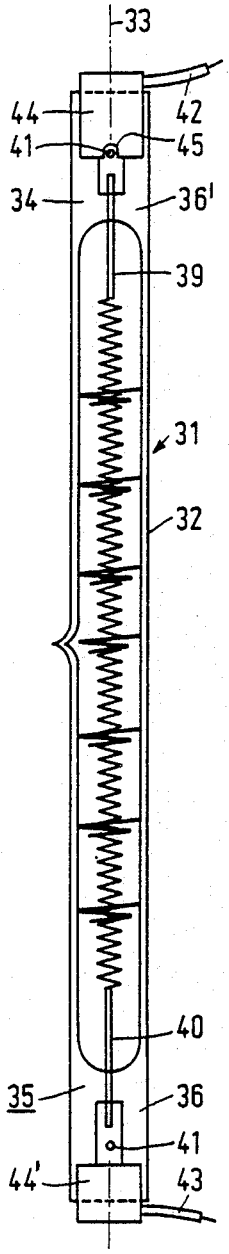
FIG. 3 shows a variation of the lamp shown in FIG. 1 in side elevation.

In FIG. 3, reference numerals which are 30 higher designate parts corresponding to parts in FIG. 1.

In the lamp shown, the elevation behind the plane of the drawing is the mirror image of the elevation shown. Each of the two major faces 36 (37) and 36' (37'), respectively, of each of the two pinched seals 35 and 34, respectively, has a profile 41. The profile 41 of all the major faces consists of a projection.

The free ends of the pinched seals 34,35 are held in a ceramic lamp cap 44 and 44', respectively, secured by means of cement. The lamp cap 44 has a recess 45 for each projection 41, in which said projection is accommodated. The lamp cap 44 consequently does not take over the function of the profile 41, but it does support this function. The lamp cap 44' on the pinched seal 35 offers a great advantage as compared with the lamp cap 44 on the pinched seal 34, however. Cement by which lamp caps are fixed is mostly hygroscopic. After absorption of moisture, the cement may establish a conductive connection with the current supply conductor (39,40). If the cement also gets into contact with the housing 20 (FIG. 1) of a cooker unit, the housing becomes voltage-carrying.

The profile 41 of the pinched seals 35 is axially separated from the lamp cap 44'. The lamp 31 can consequently no longer be displaced in the housing 20 of a cooker unit in such a manner that cement by which this lamp cap 44' is secured gets into contact with the housing 20.

Figure 2:
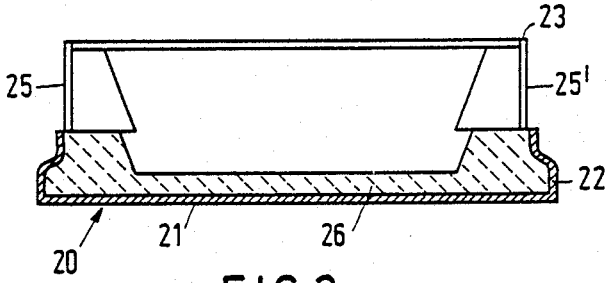
FIG. 2 is a sectional view taken on II—II in FIG. 1.
Figure 4:
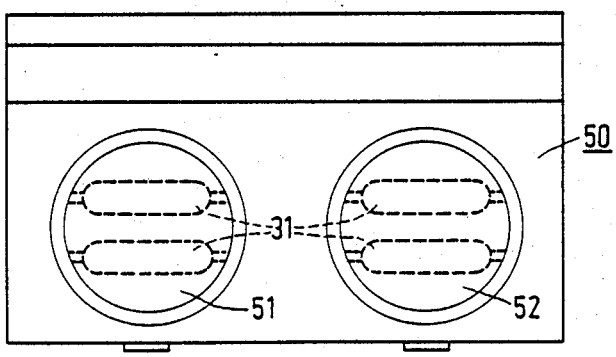
FIG. 4 is a plan view of an electric cooking apparatus.

The electric cooking apparatus 50 of FIG. 4 has two cooking areas each comprising a cooker plate 51 and 52, respectively, transparent to IR radiation, for example of glass ceramic material, under each of which an electric cooker unit of the kind shown in FIGS. 1 and 2 is situated, in which the IR lamps have the shape of FIG. 3 with two pinched seals 35, however. The cooker units are so arranged that the IR lamps face the hot plate 51 and 52, respectively.

What is claimed is:

1. An electric cooking apparatus, comprising:

an electric lamp for producing infrared radiation, said lamp comprising a tubular glass lamp envelope, a glass pinch seal at each end of said envelope for sealing said envelope in a gas-tight manner, said pinch seal having a pair of opposing major faces and a pair of opposing minor faces, a filament within said lamp envelope extending between said pinch seals, and a pair of current-supply conductors each connected to said filament, passing through a respective pinch seal, and extending away from said lamp envelope;

a housing for holding said lamp, said housing comprising a base, and a wall portion having an aperture shaped and positioned for receiving a said pinch seal; and securing means securing said lamp in said housing, said securing means comprising a face of a said glass pinch seal having a profile, said aperture having an edge portion engaging said profile and preventing translation of said lamp in a direction transverse to said wall portion.

2. An electric cooking apparatus as claimed in claim 1, wherein a major face of the pinch seal has a profile.

3. An electric cooking apparatus as claimed in claim 1, wherein a major face of each of the two pinch seals has a profile and both of said apertures have edge portions engaging said profiles.

4. An electric cooking apparatus as claimed in claim 3, wherein both major faces of each of the two pinch seals have a profile and both of said apertures have two opposing edge portions, each edge portion engaging a profile in a respective major face.

5. An electric cooker apparatus as claimed in claim 4, wherein the profile comprises a projection.

6. An electric cooking apparatus as claimed in claim 5, further comprising a ceramic lamp cap disposed on a said pinch seal and in contact with said current-supply conductor, a hydroscopic cement securing said lamp cap to said pinch seal, said lamp cap being displaced from said projection and said wall portion for preventing contact of said cement with said lamp holder wall portion whereby a short-circuit connection between said current supply conductor and said wall portion is prevented.

7. An electric cooking apparatus as claimed in 4, wherein said lamp envelope is straight and defines a lamp axis, said housing comprises a pair of opposing parallel sidewalls each having an aperture for receiving a respective pinch seal, each aperture comprising a slot having a pair of opposing edges which edges are spaced such that one of said edges engage said pinch seal profile for preventing axial translation of said lamp.

8. An electric cooking apparatus as claimed in claim 7, wherein said cooking apparatus further comprises a plate disposed opposite said base and said lamp which plate is transmissive to infrared radiation.

9. An electric lamp as claimed in claim 4, wherein said profile comprises a groove.

10. An electric cooking apparatus as claimed in 9, wherein said lamp envelope is straight and defines a lamp axis, said housing comprises a pair of opposing sidewalls each having an aperture for receiving a respective pinch seal, each aperture comprising a slot having a pair of opposing edges which edges are spaced such that one of said edges engage said pinch seal profile for preventing axial translation of said lamp.

11. An electric cooking apparatus as claimed in claim 10, wherein said cooking apparatus further comprises a plate disposed opposite said base and said lamp which plate is transmissive to infrared radiation.

12. An electric cooking apparatus as claimed in 1, wherein said lamp envelope is straight and defines a lamp axis, said housing comprises a pair of opposing parallel sidewalls each having an aperture for receiving a respective pinch seal, each aperture comprising a slot having a pair of opposing edges which edges are spaced such that one of said edges engage said pinch seal profile for preventing axial translation of said lamp.

13. An electric cooking apparatus as claimed in claim 12, wherein said cooking apparatus further comprises a plate disposed opposite said base and said lamp which plate is transmissive to infrared radiation.

14. An electric cooking apparatus as claimed in claim 12, further comprising a ceramic lamp cap disposed on a said pinch seal and in contact with said current-supply conductor, a hydroscopic cement securing said lamp cap to said pinch seal, said lamp cap being displaced from said profile and said wall portion for preventing contact of said cement with said lamp holder wall portion whereby a short-circuit connection between said current supply conductor and said wall portion is prevented.

* * * * *